US005846170A

United States Patent [19]

Ho

[11] Patent Number: 5,846,170

[45] Date of Patent: Dec. 8, 1998

[54] EXERCISING APPARATUS FOR EXERCISING ABDOMINAL MUSCLES AND FOR PERFORMING STRETCHING EXERCISES

[76] Inventor: Sung-Chao Ho, P.O. Box 24-108, Taipei, Taiwan

[21] Appl. No.: 947,498

[22] Filed: Oct. 10, 1997

[51] Int. Cl.[6] ..... A63B 21/02

[52] U.S. Cl. ..... 482/125; 482/105; 482/122; 482/124

[58] Field of Search ..... 482/121, 122, 482/124, 125, 105, 140

[56] References Cited

U.S. PATENT DOCUMENTS 5,125,649 6/1992 Fuller ..... 482/124
5,556,368 9/1996 Akin ..... 482/124
5,569,135 10/1996 Chen ..... 482/125
5,653,665 8/1997 Neeley ..... 482/125
5,674,163 10/1997 Sennett ..... 482/125

*Primary Examiner*—Lynne A. Reichard

[57] ABSTRACT

An exercising apparatus for exercising the abdominal muscles and for performing stretching exercise including an upper cross bar, a lower cross bar, and a pair of elastic bands or springs. The upper cross bar has a pair of foot pedals fixedly disposed at both ends thereof. The lower cross bar is centrally and fixedly provided with an abdomen pad. Soft packing sleeves are fitted on the lower cross bar at both sides of the abdomen pad. The upper cross bar and the lower cross bar are arranged opposite to each other with the elastic bands or springs detachably connected to both sides thereof such that a substantially rectangular structure is formed. The abdomen pad has insert holes for receiving weights.

4 Claims, 4 Drawing Sheets

EXERCISING APPARATUS FOR EXERCISING ABDOMINAL MUSCLES AND FOR PERFORMING STRETCHING EXERCISES

BACKGROUND OF THE INVENTION (a) Field of the Invention

The present invention relates generally to a dual purpose exercising apparatus, and more particularly to an apparatus which may allow the user to strengthen the abdominal muscles and to perform body and arms stretching exercises, the apparatus being simple in construction, easy to assemble, and quick to dismantle for storage.

(b) Description of the Prior Art

Conventional exercising apparatuses are usually bulky and space-occupying. They are also costly. For ordinary homes where available space is limited, use of such bulky exercising apparatus may pose problems, because they are inconvenient to store and may cause accidents if not properly placed. For conventional detachable exercising apparatus, they are not convenient to dismantle and assemble. It is therefore desirable to have an exercising apparatus that will not occupy much space in the home, and that may be easily installed and dismantled.

SUMMARY OF THE INVENTION

According to a first aspect of the present invention, the exercising apparatus comprises an upper cross bar and a lower cross bar disposed opposite to each other. The upper cross bar has a pair of foot pedals at both ends respectively. The lower cross bar is centrally and fixedly provided with an abdomen pad with insert holes thereon, and is fitted with soft packing sleeves at both sides of the abdomen pad. The upper and lower cross bars are connected by elastic bands or springs disposed at both sides thereof. In use, the user places his/her feet on the foot pedals and holds the lower cross bar with both hand, in a standing or sitting posture. The user may then pull the lower cross bars with both hands to perform stretching exercises. The user may also lie down and rest the feet on the foot pedals of the upper cross bar, with the knees curved, and place the abdomen pad on his/her abdomen. By holding the ends of the lower cross bar, the user may raise his/her body so that the abdominal muscles pushes the abdomen pad up and down.

According to a second aspect of the present invention, the exercising apparatus may be dismantled with ease after use. The elastic bands or springs joining the upper and lower cross bars may be easily taken down so that the upper and lower cross bars may be put side by side to save space in storage.

According to a third aspect of the present invention, the exercising apparatus may meet different exercising or training requirements. Elastic bands or springs of a desirable tensile force and length may be selected and mounted on the upper and lower cross bars. Besides, weights may be inserted into the abdomen pad for training purposes.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
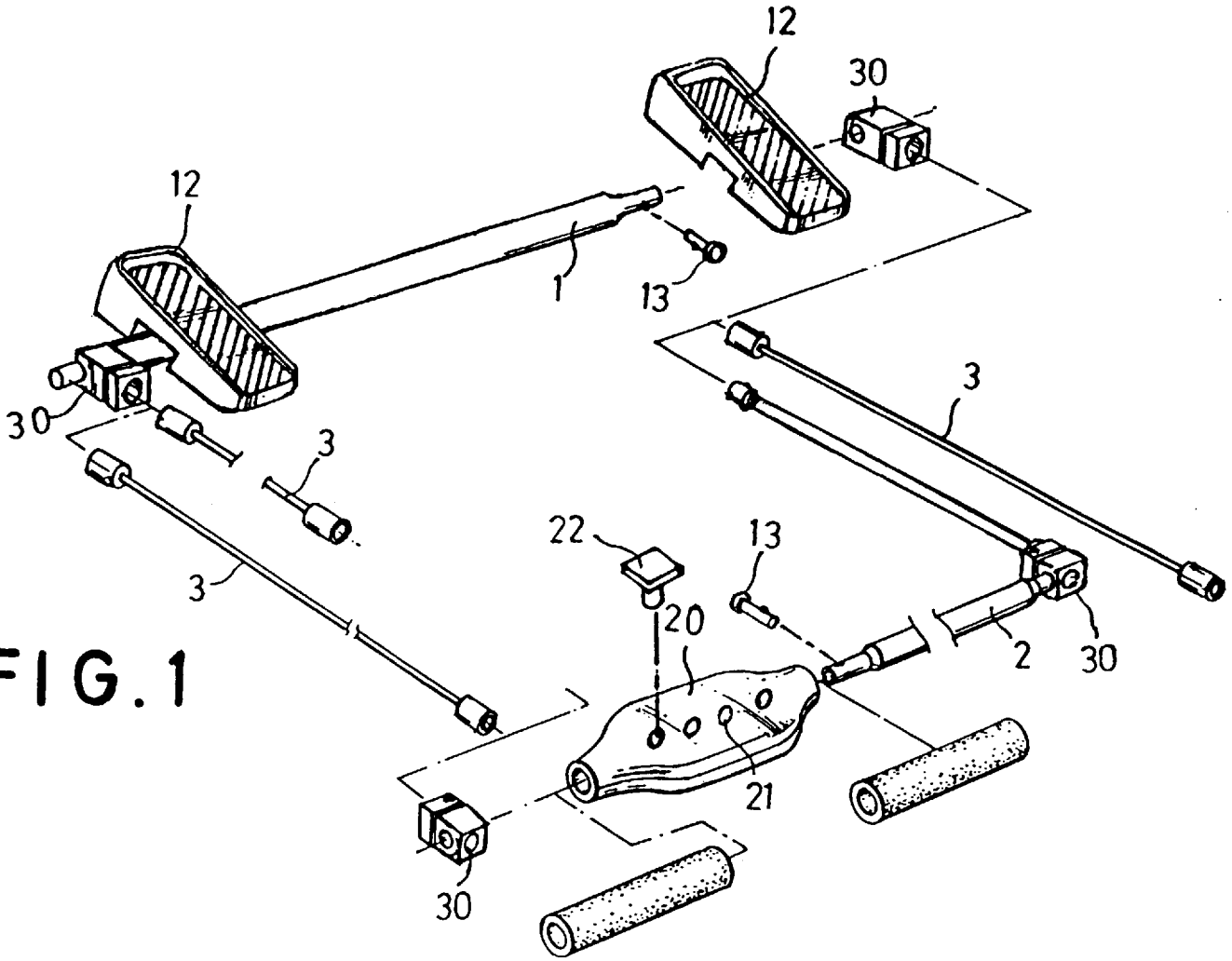
FIG. 1 is a perspective exploded view of a preferred embodiment of the present invention.
Figure 2:
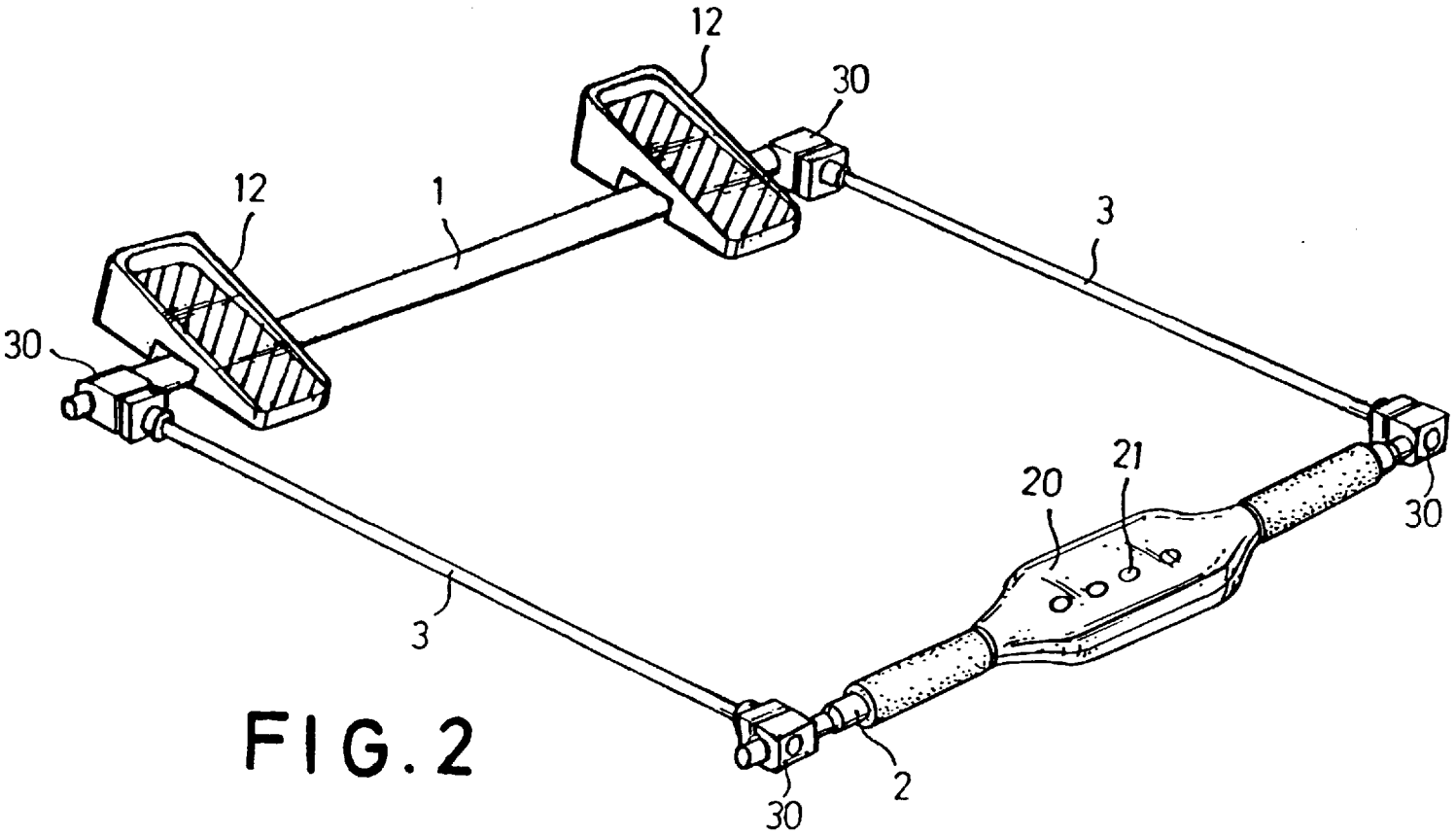
FIG. 2 is a perspective view of the preferred embodiment of the present invention.

With reference to the drawings, the present invention essentially comprises an upper cross bar 1, a lower cross bar 2, and a pair of elastic bands or springs 3. The upper cross bar 1 has two ends each being provided with a foot pedal 12. The lower cross bar 2 is centrally fixedly provided with an abdomen pad 20 having a plurality of insert holes 21 thereon for receiving weights 22. Soft packing sleeves are fitted onto the lower cross 2 at both sides of the abdomen pad 20. The upper and lower cross bars 1 and 2 are disposed opposite to each other with the two elastic springs 3 arranged at both sides thereof to form a substantially rectangular frame. The ends of the upper and lower cross bars 1, 2 are provided with respective insert pins 13, whereas the ends of each elastic band 3 are provided with respective binding sleeves 30 with insert holes. By means of the insert pins 13 and the binding sleeves 30, the upper and lower cross bars 1, 2 and the elastic bands 3 may be inter-connected the substantially rectangular frame. The elastic bands 3 may be easily disassembled for replacement of elastic bands of different tensile force or different lengths so as to adapt to users of different requirements. It should be understood that the upper and lower cross bars 1, 2 and the elastic bands or springs 3 may be connected using other means than insert pins 13 and binding sleeves 30 such as hooks and locking screws, etc., which are well known in the art.

Figure 3:
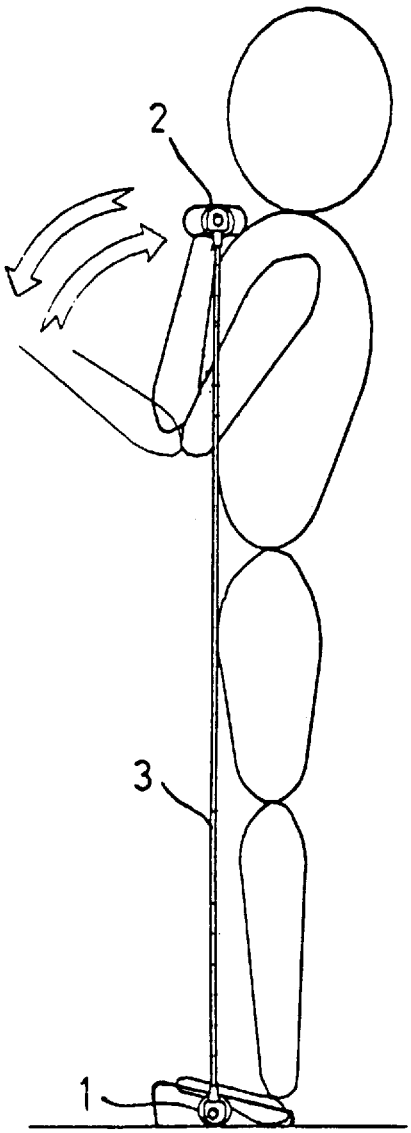
FIG. 3 is a schematic view of the preferred embodiment of the present invention when it is used for stretching exercise.
Figure 4:
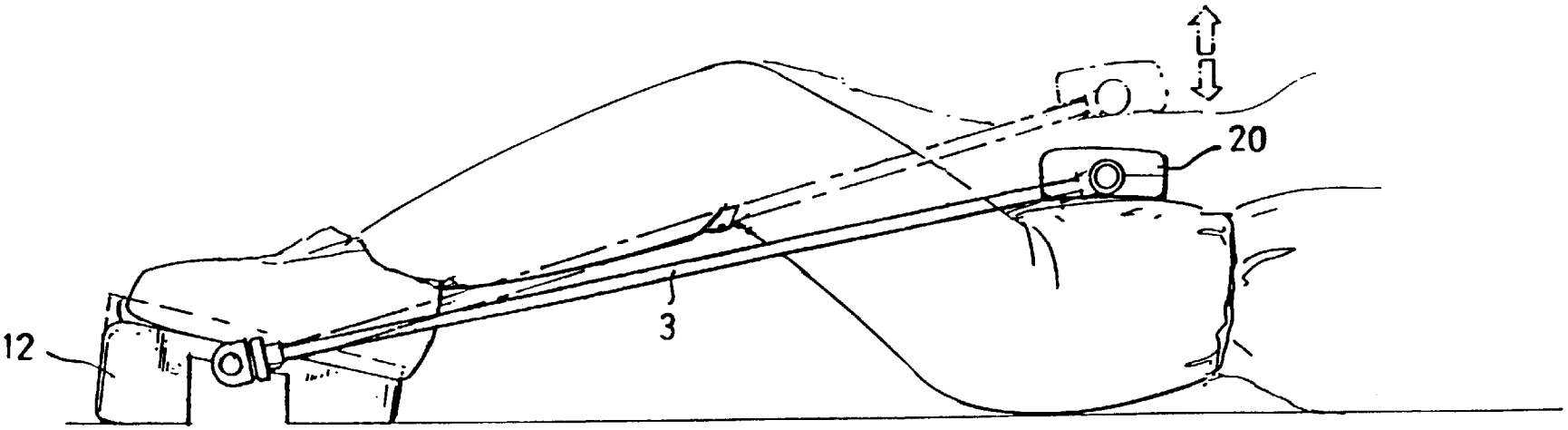
FIG. 4 is a schematic view of the present invention when it is used for training the abdominal muscles.

In actual use, referring to FIGS. 3 and 4, the user may firstly select to assemble elastic bands or springs 3 of a desirable tensile force and length to the upper and lower cross bars 1 and 2. The user may then step on the foot pedals 12 in a standing or sitting posture, with both hands holding the ends of the lower cross bar 2. In this way, the arms may exert forces and cooperate with the body to perform pulling stretching exercises. FIG. 3 illustrates a user performing exercises using the present invention in a standing posture. If it is felt that the tensile force of the elastic bands or springs 3 is too great or too little, they may be replaced very easily and quickly. Furthermore, the user may lie face up on the floor with the knees curved, feet pressing the foot pedals 12, and both hands holding the ends of the lower cross bar 2, with the abdomen pad 20 pressing down on the abdomen. In this way, the user may exercise the abdominal muscles by raising his/her body up and down so that the abdomen pushes the abdomen pad 20 which will retract with the resilient action of the elastic bands or springs 3. The user may then exercise the muscles of not only the abdomen but also the waist and the hips. Weights 22 of different weight may be inserted into the insert holes 21 of the abdomen pad 20 to achieve different degree of muscle training. After use, the elastic bands or springs 3 may be taken down from the upper and lower cross bars 1 and 2 with ease. The upper and lower cross bars 1 and 2 may be put side by side and stored conveniently, without occupying much floor space. Besides, the apparatus of the invention may be quickly assembled and installed for use.

Although the present invention has been illustrated and described with reference to the preferred embodiment thereof, it should be understood that it is in no way limited to the details of such embodiment but is capable of numerous modifications within the scope of the appended claims.

What is claimed is:

1. An exercising apparatus for exercising abdominal muscles and performing body stretching exercises, said apparatus comprising an upper cross bar, a lower cross bar, and a pair of elastic elements, said upper cross bar having a pair of foot pedals respectively fixedly disposed at both ends thereof, said lower cross bar being centrally and fixedly provided with an abdomen pad, and being fitted with soft packing sleeves at both sides of said abdomen pad, said upper cross bar and said lower cross bar being arranged opposite to each other with said elastic elements detachably connected to both sides thereof such that a substantially rectangular structure is formed.

2. An exercising apparatus as claimed in claim 1, wherein said abdomen pad is provided with a plurality of insert holes for receiving different weights.

3. An exercising apparatus as claimed in claim 1, wherein said elastic elements are elastic bands.

4. An exercising apparatus as claimed in claim 1, wherein said elastic elements are springs.

* * * * *